US007841331B2

(12) United States Patent
Liao

(10) Patent No.: US 7,841,331 B2
(45) Date of Patent: Nov. 30, 2010

(54) PAINTBALL GUN

(75) Inventor: Sheng-Jen Liao, Fongyuan (TW)

(73) Assignee: Yao-Gwo Gan, Taichung (TW)

( * ) Notice: Subject to any disclaimer, the term of this patent is extended or adjusted under 35 U.S.C. 154(b) by 112 days.

(21) Appl. No.: 12/367,469

(22) Filed: Feb. 6, 2009

(65) Prior Publication Data

US 2010/0199962 A1 Aug. 12, 2010

(51) Int. Cl.
*F41B 11/00* (2006.01)

(52) U.S. Cl. ..... 124/77

(58) Field of Classification Search ..... 124/71–77, 124/80, 31, 32
See application file for complete search history.

(56) References Cited

U.S. PATENT DOCUMENTS 7,395,819 B2 * 7/2008 Dobbins et al. ..... 124/71
7,451,755 B2 * 11/2008 Dobbins et al. ..... 124/71
7,617,820 B2 * 11/2009 Jones ..... 124/77
2006/0124118 A1 * 6/2006 Dobbins ..... 124/77
2006/0162716 A1 * 7/2006 Dobbins et al. ..... 124/77
2006/0278206 A1 * 12/2006 Dobbins et al. ..... 124/74
2007/0113836 A1 * 5/2007 Dobbins ..... 124/73
2007/0175465 A1 * 8/2007 Quinn et al. ..... 124/74
2008/0264399 A1 * 10/2008 Dobbins et al. ..... 124/71
2009/0064981 A1 * 3/2009 Dobbins et al. ..... 124/71
2009/0133682 A1 * 5/2009 Dobbins ..... 124/77
2010/0051008 A1 * 3/2010 Lian ..... 124/73
2010/0083944 A1 * 4/2010 Dobbins ..... 124/73
2010/0101550 A1 * 4/2010 Carnall ..... 124/76
2010/0108049 A1 * 5/2010 Dobbins ..... 124/77
2010/0170492 A1 * 7/2010 Tiberius et al. ..... 124/74

* cited by examiner

*Primary Examiner*—Troy Chambers
(74) *Attorney, Agent, or Firm*—Banger Shia

(57) ABSTRACT

A paintball gun includes an air valve and a body portion, in which the body portion includes a paintball hole, an axle sleeve and a bolt. By the position change of the air valve, the movement of the bolt is, therefore, controlled between the third and fourth positions, so as to selectively turn the effusion passage open or closed to control the pneumatic air to flow out of the projection passage and projection hole to project the paintball.

5 Claims, 5 Drawing Sheets

PAINTBALL GUN

BACKGROUND OF THE INVENTION

1. Field of the Invention

The present invention relates to a paintball gun with high performance, low air consumption.

2. Description of the Prior Art

The paintball sport has been played for decades and is widely spread around the globe. The paintball gun is the main piece of equipment in the sport of paintball, and it is ameliorated constantly such that it has become a mature technical field.

In a conventional paintball gun, the gun body thereof mainly includes a bolt, some valve assemblies and air passages. Therefore, to further increase the compressed air efficiency and the carry of paintball as well as to reduce the failure rate of paintball gun are still the primary object for the people skilled in this art.

SUMMARY OF THE INVENTION

The main object of the present invention is to provide a paintball gun with high performance, low air consumption.

To achieve the above object, a paintball gun is provided. The paintball gun includes an air valve and a body portion, in which the body portion includes a paintball hole, an axle sleeve and a bolt.

By the position change of the air valve, the movement of the bolt is, therefore, controlled between the third and fourth positions, so as to selectively turn the effusion passage open or closed to control the pneumatic air to flow out of the projection passage and projection hole to project the paintball.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
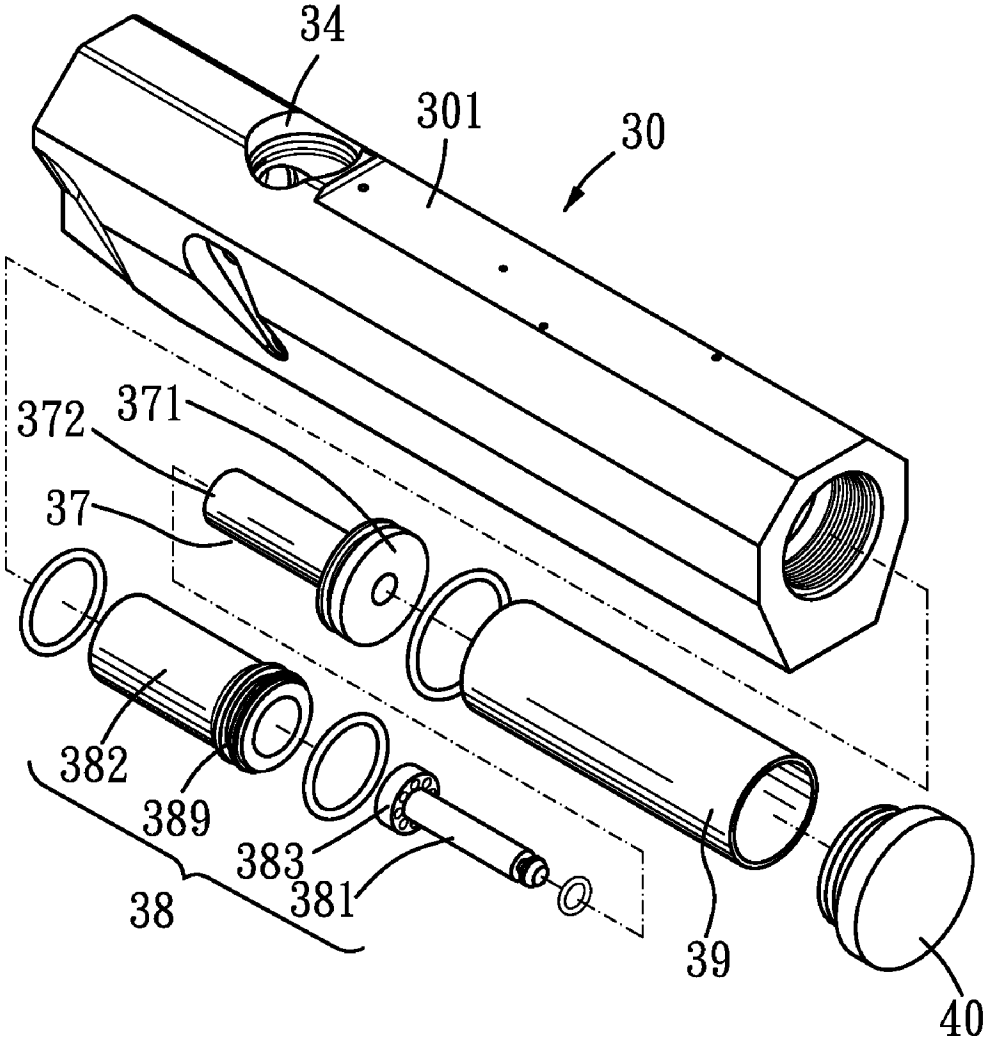
FIG. 1 is a breakdown drawing showing a paintball gun in accordance with a preferred embodiment of the present invention.
Figure 2:
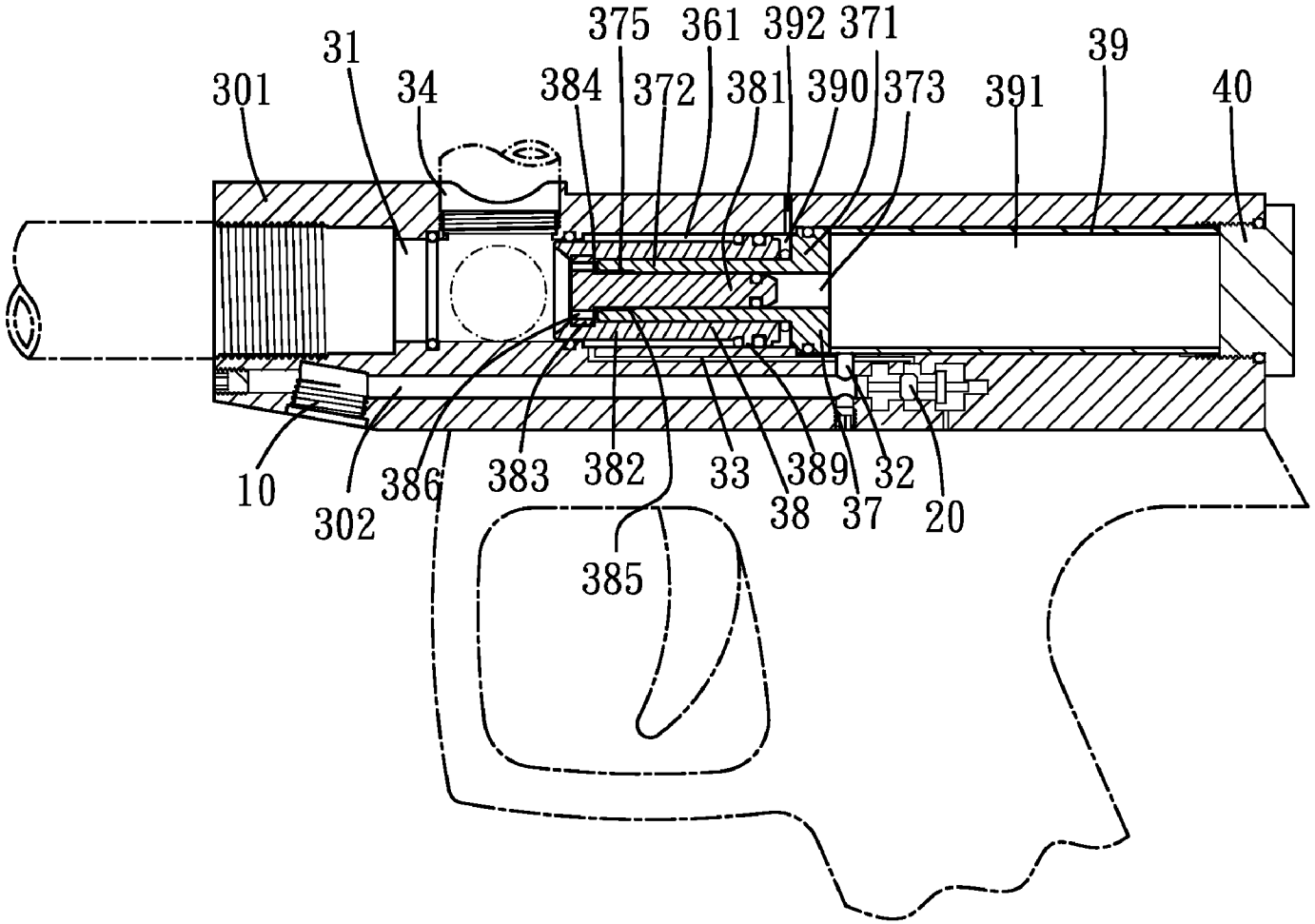
FIG. 2 is a profile showing a paintball gun in accordance with a preferred embodiment of the present invention, in which the air valve is at the first position.

First, please refer to FIG. 1 and FIG. 2. A paintball gun of the present invention includes a pneumatic air source (not shown, will connect to a combining portion 10 if there's any), an air valve 20, a body portion 30, a grip, a trigger (not shown) and a barrel (not shown). One end of the air valve 20 communicates the surrounding, and it is selectively turned open or closed corresponding to the motion of the trigger.

In the present embodiment, the body portion 30 includes a main body 301, which has a hollow receiving room 31, a first air bore 32 and a second air bore 33. And, the body portion 30 further includes a paintball hole 34, an axle sleeve 37, a bolt 38, an air storage 39 and a rear cover 40. In addition, the main body 301 further has an inlet 302 communicating with the combining portion 10 so that the inlet 302 is filled with pneumatic air.

The rear cover 40 is fastened to a rear end of the main body 301, while the air storage 39 is installed in the main body 301. An air chamber 391 is defined within the air storage 39. The paintball hole 34 is disposed at a relative front portion of the main body 301 to load a paintball into the receiving room 31 therefrom.

The axle sleeve 37 has a first end 371 and a second end 372, in which the first end 371 tightly engaging with an inner wall of the main body 301. An air passage 373 is axially disposed through the axle sleeve 37 while the first air bore 32 communicates the air passage 373 with the inlet 302.

The bolt 38 is movable between a third position and a fourth position, and it includes an inner rod 381 and an outer sleeve 382. An outer diameter of the inner rod 381 is substantially equal to a bore diameter of the air passage 373 such that the inner rod 381 is axially-movably fit in the air passage 373. A bore diameter of the outer sleeve 382 is not smaller than an outer diameter of the axle sleeve 37, and it would be preferred if the bore diameter of the outer sleeve 382 is equal to the outer diameter of the axle sleeve 37. Between the inner rod 381 and the outer sleeve 382 is disposed a linkup 383 so that the inner rod 381 and the outer sleeve 382 are coupled into a linkage relationship. And, the linkup 383 is disposed closed to one end of the bolt 38 away from the first end 371 of the axle sleeve 37. In addition, between the inner rod 381, the outer sleeve 382, the linkup 383 and the axle sleeve 37 is defined a projection passage 384, and between the projection passage 384 and the air passage 373 is disposed an effusion passage 385, which is selectively turned open or closed. Moreover, at least a projection hole 386 is axially penetrating the linkup 383 and communicating the projection passage 384. At a predetermined position of an outer periphery of the outer sleeve 382 is formed with an enlarged flange 389, and between the flange 389, the outer sleeve 382 and the main body 301 is defined a first chamber 361. A contacting area between the first chamber 361 and the flange 389 is a first surface, and an area of the first surface is larger than that of a radial profile of the inner rod 381. Furthermore, the second air bore 33 communicates the first chamber 361 with the air valve 20.

Figure 3:
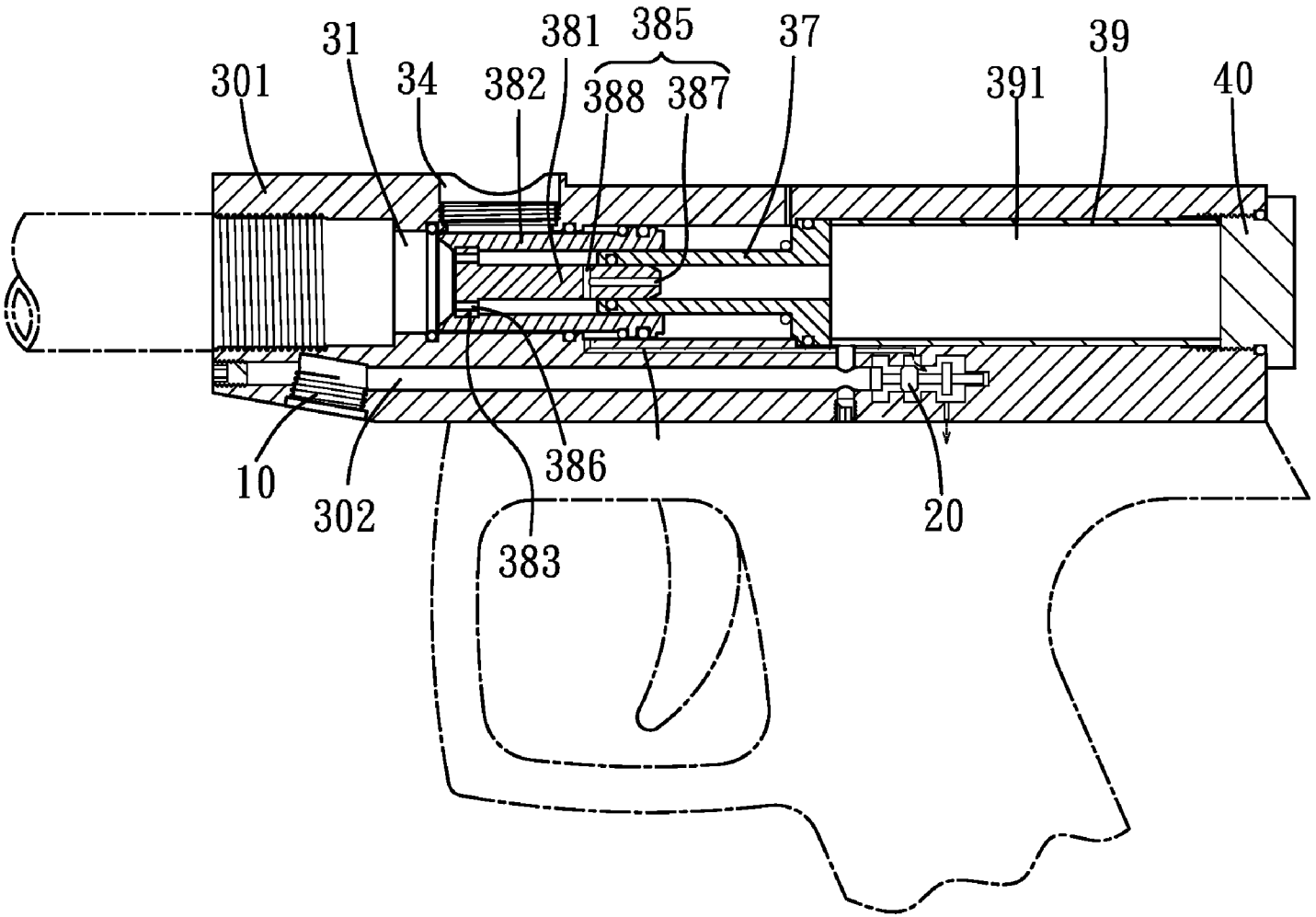
FIG. 3 is a profile showing a paintball gun in accordance with another embodiment of the present invention.

In the present embodiment, the second end 372 of the axle sleeve 37 has an enlarged section 375, in which a bore diameter of the enlarged section 375 is larger than that of the air passage 373. The effusion passage 385 is, therefore, defined between the enlarged section 375 and the inner rod 381. However, the effusion passage 385 can also be designed as shown in FIG. 3, in which the effusion passage 385 includes an axial bore 387 and a radial bore 388. The axial bore 387 is disposed in one end of the inner rod 381 proximate to the first end 371 of the axle sleeve 37, and the radial bore 388, communicating with the axial bore 387, is disposed at a predetermined position of the inner rod 381.

Please continue to refer to FIG. 2. When the air valve 20 is at the first position, the air valve 20 communicates the inlet 302 with the second air bore 33, such that the air in the pneumatic source flows into the first chamber 361 via the second air bore 33, and into the air passage 373 and the air chamber 391 via the first air bore 32. Because the area of the first surface is larger than that of the radial profile of the inner rod 381, the bolt 38 is then pushed to the third position and shuts the effusion passage 385. Meanwhile, the paintball hole 34 is opened for a paintball to drop into the receiving room 31. In addition, between the flange 389, the axle sleeve 37 and the main body 301 is defined a second chamber 390, and at a predetermined position of the main body 301 is disposed a second decompression bore 392 communicating the second chamber 390 with the surrounding, such that when the bolt 38 is at the third position, the air left in the second chamber 390 is evacuated to the surrounding from the second decompression bore 392.

Figure 4:
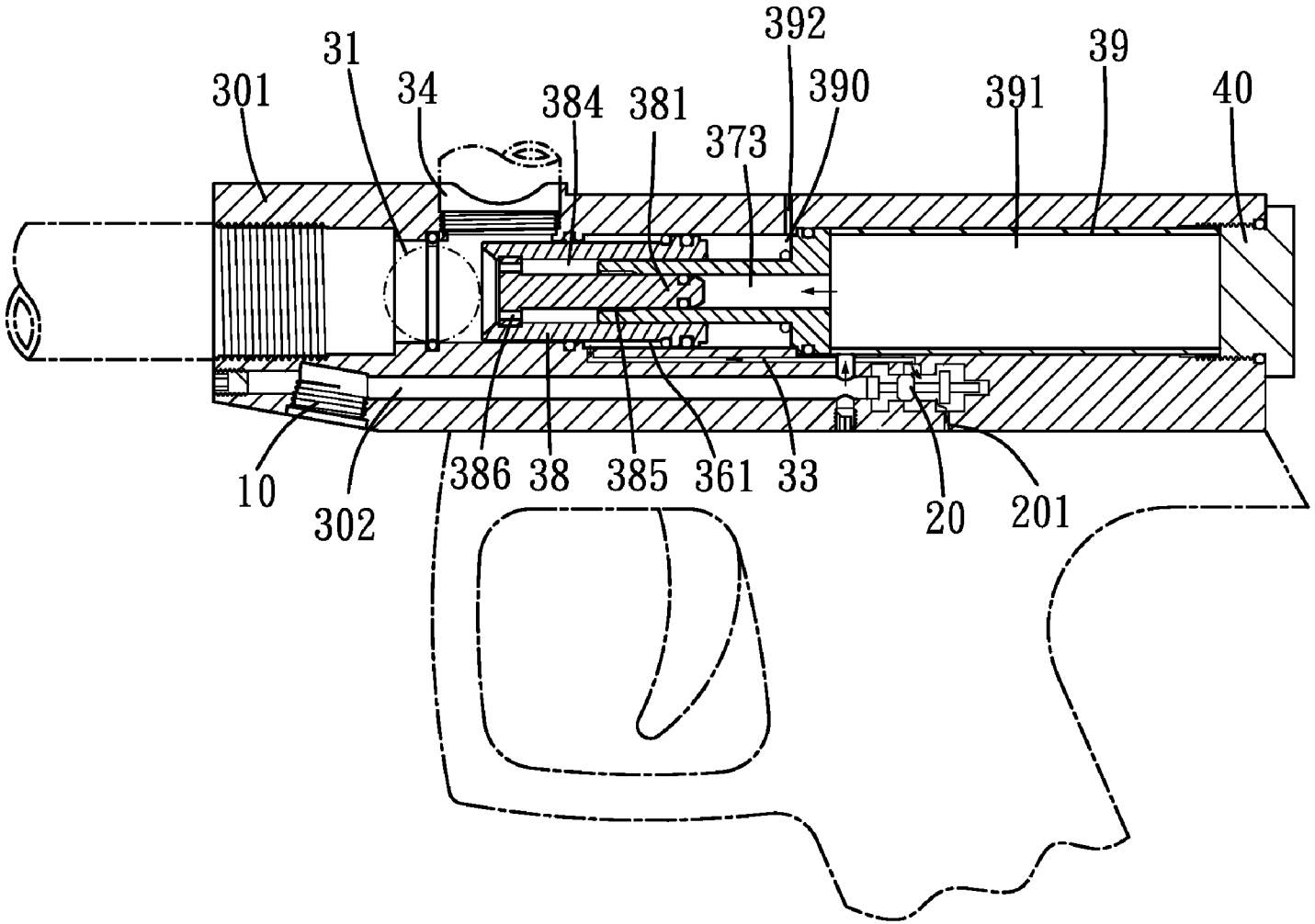
FIG. 4 is a profile showing a pneumatic movement (I) of a paintball gun in accordance with a preferred embodiment of the present invention, in which the air valve is at the second position.
Figure 5:
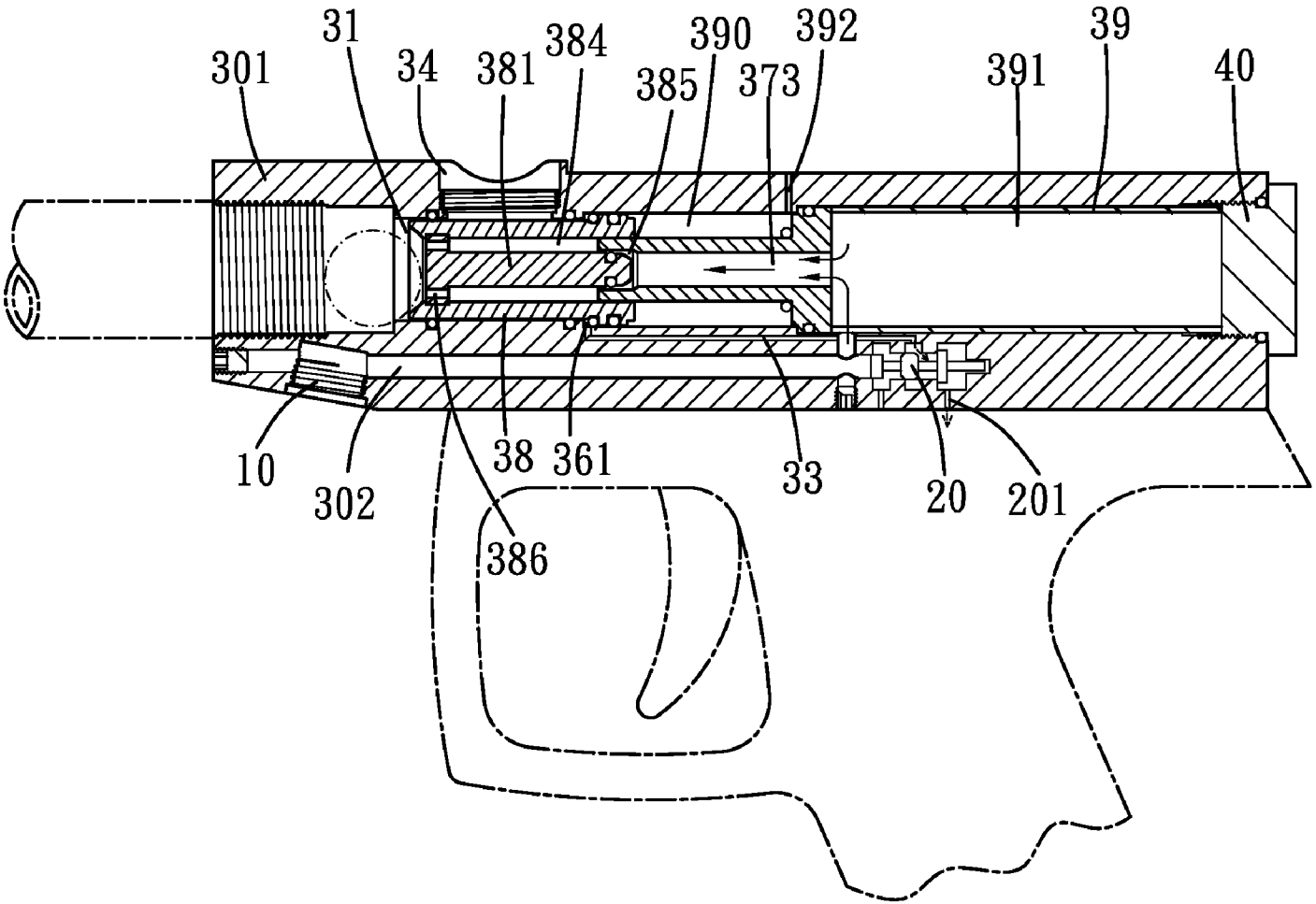
FIG. 5 is a profile showing a pneumatic movement (II) of a paintball gun in accordance with a preferred embodiment of the present invention, in which the air valve is at the second position.

Next, please refer to FIG. 4 and FIG. 5. When the air valve 20 is at the second position, the air valve 20 communicates the second air bore 33 with a first decompression bore 201, which communicates the surrounding. At the instant, the air in the first chamber 361 is evacuated through the first decompression bore 201, and then the air in the air passage 373 pushes the inner rod 381 so as to further push the bolt 38 to the fourth position and shut the paintball hole 34. Meanwhile, the effusion passage 385 is open for the air to evacuate from the projection passage 384 and the projection hole 386, so as to project the paintball.

In summary, the paintball gun of the present invention has just a few parts which are relatively easy to be installed than the conventional ones. An air chamber is disposed behind the communicator to provide sufficient and steady air source to increase the projection range of the paintball gun. And, the pull of trigger controls the movement of the air valve, so as to further control the movement of the bolt, which increases the utilization rate of pneumatic air and streamlines the paintball gun such that the volume of the paintball gun is shortened, making the paintball gun easy to carry. In addition, the air valve does not involve in the communication between the pneumatic air source and the projection passage as convention art does, which reduces the consumption of air and smoothes the flow of pneumatic air to increase the initial projection speed.

What is claimed is:

1. A paintball gun, comprising:

an air valve, being selectively moved to a first position or a second position; and a body portion, comprising a main body having a hollow receiving room, a first air bore and a second air bore, the body portion further comprising:

a paintball hole, disposed at a predetermined position of the main body and communicating with the receiving room;

an axle sleeve, having a first end and a second end, the first end tightly engaging with an inner wall of the main body, an air passage being axially disposed through the axle sleeve while the first air bore communicating the air passage with an inlet; and a bolt, being movable between a third position and a fourth position, the bolt comprising an inner rod and an outer sleeve, an outer diameter of at least a part of the inner rod being substantially equal to a bore diameter of the air passage such that the inner rod being axially-movably fit in the air passage, a bore diameter of the outer sleeve being not smaller than an outer diameter of the axle sleeve, between the inner rod and the outer sleeve being disposed a linkup so that the inner rod and the outer sleeve being coupled into a linkage relationship, the linkup being disposed close to one end of the bolt away from the first end of the axle sleeve, between the inner rod, the outer sleeve, the linkup and the axle sleeve being defined a projection passage, between the projection passage and the air passage being disposed an effusion passage, the effusion passage being selectively turned open or closed, at least a projection hole being axially penetrating the linkup and communicating the projection passage, at a predetermined position of an outer periphery of the outer sleeve being formed with an enlarged flange, between the flange, the outer sleeve and the main body being defined a first chamber, a contacting area between the first chamber and the flange being a first surface, an area of the first surface being larger than that of a radial profile of the inner rod, and the second air bore communicating the first chamber with the air valve;

wherein, when the air valve is at the first position, the air valve communicates the inlet with the second air bore, such that air in the inlet flows into the first chamber via the second air bore, and into the air passage via the first air bore, the bolt is then pushed to the third position and shuts the effusion passage because the area of the first surface is larger than that of the radial profile of the inner rod, meanwhile, the paintball hole is opened for a paintball to drop into the receiving room;

wherein, when the air valve is at the second position, the air valve communicates the second air bore with a first decompression bore, at the instant, the air in the first chamber is evacuated through the first decompression bore, and then the air in the air passage pushes the inner rod so as to further push the bolt to the fourth position and shut the paintball hole, meanwhile, the effusion passage is open for the air to evacuate from the projection passage and the projection hole so as to project the paintball.

2. The paintball gun of claim 1, wherein the second end of the axle sleeve has an enlarged section, a bore diameter of the enlarged section is larger than that of the air passage, and the effusion passage is defined between the enlarged section and the inner rod.

3. The paintball gun of claim 1, wherein an axial bore is disposed in one end of the inner rod proximate to the first end of the axle sleeve, at a predetermined position of the inner rod is disposed a radial bore communicating with the axial bore, and the effusion passage comprises the axial bore and the radial bore.

4. The paintball gun of claim 1, wherein between the flange, the axle sleeve and the main body is defined a second chamber, at a predetermined position of the main body is disposed a second decompression bore communicating the second chamber with a surrounding.

5. The paintball gun of claim 1, wherein the main body further comprises an air storage, the air storage abuts the first end of the axle sleeve, an air chamber is defined within the air storage, and the air chamber communicates the air passage;

wherein, when the air valve is at the first position, the air in the inlet also flows into the air chamber through the first air bore;

wherein, when the air valve is at the second position, the air in the air chamber also flows into the air passage to push the inner rod.

* * * * *